US008602760B2

(12) United States Patent
Maeyama et al.

(10) Patent No.: US 8,602,760 B2
(45) Date of Patent: Dec. 10, 2013

(54) VANE COMPRESSOR

(75) Inventors: Hideaki Maeyama, Tokyo (JP); Shinichi Takahashi, Tokyo (JP); Masahiro Hayashi, Tokyo (JP); Hirotsugu Hayashi, legal representative, Tokyo (JP); Shin Sekiya, Tokyo (JP); Tetsuhide Yokoyama, Tokyo (JP); Hideto Nakao, Tokyo (JP); Tatsuya Sasaki, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 161 days.

(21) Appl. No.: 13/084,929

(22) Filed: Apr. 12, 2011

(65) Prior Publication Data

US 2012/0009078 A1 Jan. 12, 2012

(30) Foreign Application Priority Data

Jul. 12, 2010 (JP) ..... 2010-158253

(51) Int. Cl.
*F03C 2/00* (2006.01)
*F03C 4/00* (2006.01)
*F04C 2/00* (2006.01)

(52) U.S. Cl.
USPC ..... 418/259; 418/150; 418/140; 418/145; 418/268

(58) Field of Classification Search
USPC ..... 418/150, 112, 137–138, 140, 145, 257, 418/259, 266–268
See application file for complete search history.

(56) References Cited

U.S. PATENT DOCUMENTS 4,410,305 A 10/1983 Shank et al.
4,657,491 A 4/1987 Frank
4,898,526 A * 2/1990 Sakamaki et al. ..... 418/257
4,955,985 A 9/1990 Sakamaki et al.
4,958,995 A 9/1990 Sakamaki et al.

(Continued)

FOREIGN PATENT DOCUMENTS

CH 181039 A 11/1935
JP SHO40-20520 U 7/1965

(Continued)

OTHER PUBLICATIONS

Kemp et al., "Novel Rotary Spool Compressor Design and Preliminary Prototype Performance" International Compressor Engineering Conference at Purdue, Jul. 14-17, 2008, 1328, pp. 1-10.

(Continued)

*Primary Examiner* — Theresa Trieu
(74) *Attorney, Agent, or Firm* — Buchanan Ingersoll & Rooney PC

(57) ABSTRACT

A vane compressor according to the present invention, including a cylinder which is approximately cylindrical and whose both ends located in an axial direction are open, a cylinder head and a frame which close both the ends of the cylinder, a rotor shaft which includes a rotor part being cylindrical and rotating in the cylinder and a shaft part transmitting torque to the rotor part, and a vane which is installed in the rotor part and whose tip portion has the R-shape facing outward, performs the compression operation in the state where the normal to the R-shape of the tip portion of the vane and the normal to the inner surface of the cylinder are always approximately coincident with each other.

16 Claims, 10 Drawing Sheets

(56) References Cited

U.S. PATENT DOCUMENTS

| | | | | |
|---|---|---|---|---|
| 4,997,351 | A | 3/1991 | Sakamaki et al. | |
| 4,997,353 | A | 3/1991 | Sakamaki et al. | |
| 4,998,867 | A | 3/1991 | Sakamaki et al. | |
| 4,998,868 | A | 3/1991 | Sakamaki et al. | |
| 5,002,473 | A | 3/1991 | Sakamaki et al. | |
| 5,011,390 | A | 4/1991 | Sakamaki et al. | |
| 5,022,842 | A | 6/1991 | Sakamari et al. | |
| 5,030,074 | A | 7/1991 | Sakamaki et al. | |
| 5,032,070 | A | 7/1991 | Sakamaki et al. | |
| 5,033,946 | A | 7/1991 | Sakamaki et al. | |
| 5,044,910 | A | 9/1991 | Sakamaki et al. | |
| 5,087,183 | A | 2/1992 | Edwards | |
| 5,160,252 | A | 11/1992 | Edwards | |
| 5,947,712 | A * | 9/1999 | Viegas et al. | 418/259 |
| 6,106,255 | A * | 8/2000 | Viegas et al. | 418/268 |
| 6,663,370 | B1 * | 12/2003 | Simonds | 418/259 |
| 6,821,099 | B2 * | 11/2004 | Wilk et al. | 418/259 |

FOREIGN PATENT DOCUMENTS

| | | | |
|---|---|---|---|
| JP | SHO49-37203 | A | 4/1974 |
| JP | 56-056992 | A | 5/1981 |
| JP | 57-122189 | A | 7/1982 |
| JP | 58-070087 | | 4/1983 |
| JP | 58-197493 | | 11/1983 |
| JP | 61-132793 | | 6/1986 |
| JP | 63-029084 | A | 6/1988 |
| JP | 10-252675 | | 9/1998 |
| JP | 10-252675 | A | 9/1998 |
| JP | 2000009069 | A | 1/2000 |
| JP | 2000-352390 | | 12/2000 |
| JP | 2000-352390 | A | 12/2000 |
| JP | 2001-115979 | | 4/2001 |
| JP | 3194435 | | 7/2001 |
| KR | 2002-0056457 | A | 7/2002 |

OTHER PUBLICATIONS

Korean Notice of Preliminary Rejection dated Nov. 14, 2012 issued in the corresponding Korean Patent Application No. 10-2011-0030056 and English language translation.

Japanese Office Action dated Jan. 15, 2013 issued in the corresponding Japanese Patent Application No. 2010-158253 and English-language translation.

Korean Notification of Reason for Refusal dated May 22, 2013 issued in the corresponding Korean Patent Application No. 10-2011-0030056 and English translation (8 pages).

Japanese Office Action dated Sep. 3, 2013 issued in the corresponding Japanese Patent Application No. 2010-158253 and English translation (4pages).

Chinese Office Action dated Aug. 23, 2013 issued in the corresponding Chinese Patent Application No. 2011100941552 and partial English translation (9 pages).

Korean Notification of Reason for Refusal dated Oct. 1, 2013 issued in the corresponding Korean Patent Application No. 10-2013-0082047 and partial English translation (7 pages).

* cited by examiner

VANE COMPRESSOR

TECHNICAL FIELD

The present invention relates to a vane compressor.

BACKGROUND ART

Conventionally, there has been proposed a so-called general vane compressor having a structure in which a vane is inserted in each vane groove formed at one or a plurality of locations in the rotor part of the rotor shaft composed of the cylindrical rotor part rotating within the cylinder and the shaft transmitting torque to the rotor part, where the rotor part and the shaft are integrally combined with each other, and in which the tip portion of the vane slides while contacting the inner surface of the cylinder (refer to, e.g., Patent Literature 1).

Moreover, there is proposed another vane compressor having a structure in which the inside of the rotor shaft is hollow, a fixed shaft for supporting vanes is arranged in the hollow, vanes are rotatably attached to the fixed shaft, and each of the vanes is pivotally rotatably supported with respect to the rotor part through a pair of semicircular cylindrical supporting members in the vicinity of the outer surface of the rotor part (refer to, e.g., Patent Literature 2).

CITATION LIST

Patent Literature

Patent Literature 1: Japanese Unexamined Patent Publication JP 10-252675 A (Page 4, FIG. 1)

Patent Literature 2: Japanese Unexamined Patent Publication JP 2000-352390 A (Page 6, FIG. 1)

SUMMARY OF INVENTION

Technical Problem

In the conventional general vane compressor (e.g., Patent Literature 1), the direction of each vane is restricted by a vane groove formed in the rotor part of the rotor shaft. Each vane is supported to always keep the same inclination with respect to the rotor part. Therefore, along with rotation of the rotor shaft, the angle formed by the vane and the cylinder inner surface changes. Thus, in order for the vane tip portion to contact all around the inner surface of the cylinder, the radius of the vane tip portion needs to be smaller than that of the cylinder inner surface.

That is, in the type where the vane tip portion slides while contacting the inner surface of the cylinder, since the vane tip portion having a radius greatly different from that of the cylinder inner surface slides, there occurs a boundary lubrication state between the two parts (the cylinder and the vane), not a fluid lubrication state in which sliding is performed through an oil film formed between the two parts. In general, a friction coefficient under the boundary lubrication condition is very high, approximately 0.05 or more, whereas that under the fluid lubrication condition is around 0.001 to 0.005.

In the structure of the conventional general vane compressor, since the vane tip portion slides while contacting the cylinder inner surface in the boundary lubrication state, the sliding resistance is high, and thereby the efficiency of the compressor is greatly reduced because of an increase in mechanical loss. At the same time, there has been a problem that the vane tip portion and the cylinder inner surface are easy to abrade and thus securing their long-term life is difficult. Then, in the conventional vane compressor, it has been devised to reduce the pressing force of the vane to the cylinder inner surface as much as possible.

For improving the problems described above, there has been proposed a method (e.g., Patent Literature 2) of making the inside of the rotor part hollow, and providing a fixed shaft in the hollow, wherein the fixed shaft supports vanes to be rotatable at the center of the inside diameter of the cylinder and the vanes are supported to be rotatable with respect to the rotor part through supporting members in the vicinity of the periphery of the rotor.

By virtue of this configuration, the vanes are rotatively supported at the center of the cylinder inside diameter. Therefore, the direction of each vane is always in the normal direction of the cylinder inner surface. Thus, it is possible to configure the radius of the vane tip portion and the radius of the cylinder inner surface to be approximately equal to each other so that the vane tip portion may follow the shape of the cylinder inner surface, and thereby the tip portion and the cylinder inner surface can be in non-contact with each other. Alternatively, even when the vane tip portion and the cylinder inner surface are in contact with each other, a fluid lubrication state can be produced with a sufficient oil film. Therefore, the sliding/contacting state of the vane tip portion, being the problem of the conventional vane compressor, can be improved.

However, according to the method of Patent Literature 2, since the inside of the rotor part is configured to be hollow, it is difficult to transmit torque to the rotor part and to support rotation of the rotor part. Then, in Patent Literature 2, end plates are provided at both end surfaces of the rotor part. As the end plate at one side needs to transmit force from the rotary shaft, the plate is formed in the shape of a disk and the rotary shaft is connected to its center. Another end plate at the other side needs to be formed not to interfere with the rotation ranges of the fixed shaft of the vane and the axial support member of the vane, and thus, the plate is formed in the shape of a ring having an opening in the center thereof. Therefore, the portion supporting rotation of each end plate needs to have a diameter greater than that of the rotary shaft, which causes a problem of an increase in sliding loss.

Furthermore, since between the rotor part and the cylinder inner surface a narrow space is formed in order not to let the compressed gas leak, high precision is required for the rotor part outer surface and the rotation center. However, because the rotor part and the end plate are configured with separate members, there may occur a distortion produced by connecting the rotor part to the end plate, a coaxial gap between the rotor part and the end plate, etc., which are factors of a problem degrading the precision of the rotor part outer surface and of the rotation center.

The present invention is directed to solving the problems as mentioned above, and provides a vane compressor described below.

(1) Firstly, in order to improve the mechanical loss and the short life tendency caused by the sliding/contacting of the vane tip portion in the boundary lubrication state, there is provided a vane compressor in which the radius of the R-shape of the vane tip portion and the radius of the cylinder inner surface are formed to be approximately equal to each other and a compression operation is performed such that the normals to both the radii are always approximately coincident with each other, thereby enabling the vane tip portion and the cylinder to be in a fluid lubrication state.

(2) Secondly, there is provided a vane compressor in which there is realized a mechanism of the vane rotating about the center of the cylinder in order to perform a compression operation such that the normal to the radius of the R-shape of the vane tip portion and the normal to the radius of the cylinder inner surface are always approximately coincident with each other, by the configuration of integrally combining the rotor part and the rotary shaft without using end plates of the rotor part which cause precision degradation of the rotor part outer surface and the rotation center.

(3) Thirdly, there is provided a vane compressor in which, by applying the mechanism described above, the vane tip portion and the cylinder inner surface are formed to be in non-contact with each other and gas leakage from the space between the vane tip portion and the cylinder inner surface is minimized.

(4) Fourthly, there is provided a vane compressor in which, while achieving the mechanism described above, another mechanism that, in the rotor part, the vane is pivotally rotatable and movable in the approximately normal direction is realized by a method in a manner slidable under a fluid lubrication condition.

Solution to Problem

A vane compressor according to the present invention, including a cylinder which is approximately cylindrical and whose both ends located in an axial direction are open, a cylinder head and a frame which close both the ends of the cylinder, a rotor shaft which includes a rotor part being cylindrical and rotating in the cylinder and a shaft part transmitting torque to the rotor part, and a vane which is installed in the rotor part and whose tip portion has the R-shape facing outward, the vane compressor performs the compression operation in the state where the normal to the R-shape of the tip portion of the vane and the normal to the inner surface of the cylinder are always approximately coincident with each other.

Advantageous Effects of Invention

In the vane compressor according to the present invention, since the compression operation is performed in the state where the normal to the radius of the R-shape of the tip portion of the vane and the normal to the radius of the inner surface of the cylinder are always approximately coincident with each other, the vane tip portion and the cylinder can be in a fluid lubrication state, thereby reducing mechanical loss caused by sliding/contacting and thereby improving a lifespan affected by abrasion between the vane tip portion and the cylinder inner surface.

DESCRIPTION OF EMBODIMENTS

Embodiment 1

Figure 1:
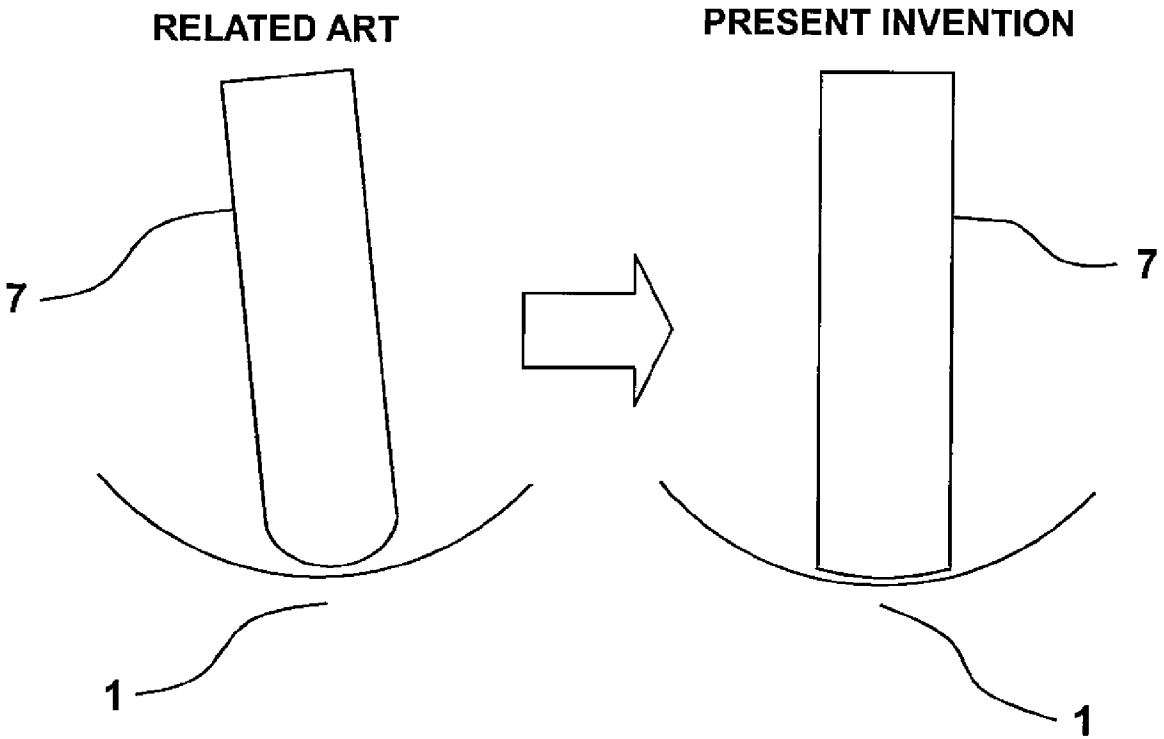
FIG. 1 shows a fundamental technical concept of the present invention.

First, the fundamental technical concept applied to the present invention will be described referring to FIG. 1. FIG. 1 shows a comparison between a conventional general vane compressor (e.g., Patent Literature 1) and a vane compressor of the present invention for explaining the fundamental technical concept of the present invention, each of them showing a vane 7 and a cylinder 1. As has been described, an art analogous to the fundamental technical concept of the present invention is disclosed in Patent Literature 2, for example. However, the present invention differs in the means (method) for realizing the fundamental technical concept. The realization means will be described in detail later.

As described above, in the conventional general vane compressor (e.g., Patent Literature 1), the direction of each vane 7 is restricted by a vane groove formed in the rotor part of the rotor shaft. Each vane 7 is supported to always keep the same inclination with respect to the rotor part. Therefore, along with rotation of the rotor shaft, the angle formed by the vane and the cylinder inner surface changes. Thus, in order for the vane tip portion to contact all around the cylinder inner surface, the radius of the tip portion of the vane needs to be smaller than that of the inner surface of the cylinder.

That is, vane tip portion radius<cylinder inner surface radius

Accordingly, the contact type (the vane tip portion slides while contacting the cylinder inner surface) and the non-contact type (the vane tip portion and the cylinder inner surface are in non-contact with each other) respectively have a problem described below.

(1) Contact type: since an oil film is not formed at a sliding portion where the tip portion of the vane contactingly slides along the inner surface of the cylinder, the state between them is boundary lubrication. As shown in the Stribeck curve of FIG. 2, the friction coefficient under the boundary lubrication condition is very high, approximately 0.05 or more, and thus the sliding resistance is high, whereas the friction coefficient under the fluid lubrication condition is around 0.001 to 0.005.

(2) Non-contact type: except for the most proximal point between the vane tip portion and the cylinder inner surface, the space between them is large, thereby causing large refrigerant leakage.

In contrast, according to the present invention, the radius of the tip portion of the vane and the radius of the inner surface of the cylinder are formed to be approximately equal to each other, and the compression operation is performed in the state where the normal to the radius of the vane tip portion and the normal to the radius of the cylinder inner surface are always approximately coincident with each other.

That is, vane tip portion radius≈cylinder inner surface radius

A means for realizing the above will be explained in detail later, but now an example is described below. As a method for supporting the vane so that the vane may always be in the normal direction of the cylinder inner surface or may have a fixed inclination with respect to the normal direction of the cylinder inner surface, a concave portion or a ring-shaped groove being concentric with the cylinder inner surface is formed on the surface at the cylinder side of the cylinder head and/or the frame, a vane aligner having a plate-like projection on its ring-shaped surface is inserted in the concave portion or the ring-shaped groove, and the plate-like projection is inserted in the groove formed in the vane. Thereby, the vane direction with respect to the normal of the cylinder is restricted to be predeterminedly fixed. The present invention greatly differs in this point from the realization means described in Patent Literature 2, for example, which discloses an art analogous to the fundamental technical concept of the present invention, and thus the present invention has an inventive step.

By having the configuration of the vane tip portion radius≈cylinder inner surface radius, the contact type (the vane tip portion slides while contacting the cylinder inner surface), and the non-contact type (the vane tip portion and the cylinder inner surface are in non-contact with each other) respectively obtain preferable states as described below.

Figure 2:
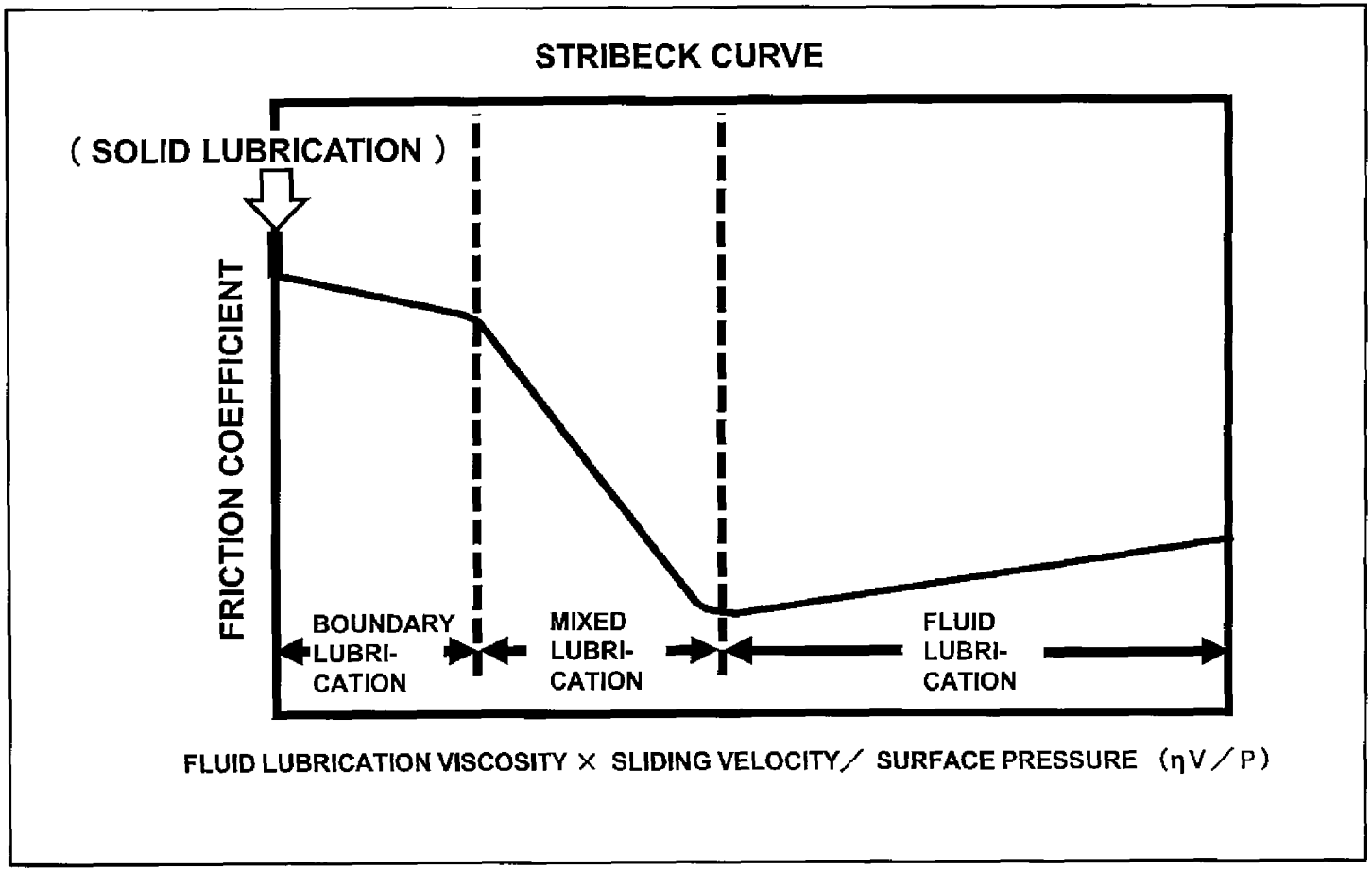
FIG. 2 shows a Stribeck curve.

(1) Contact type: since an oil film is formed at the sliding portion where the tip portion of the vane contactingly slides along the inner surface of the cylinder, the state between them is fluid lubrication as shown in the Stribeck curve of FIG. 2. The friction resistance at the sliding portion is around 0.001 to 0.005 in the fluid lubrication state, thereby having a low sliding resistance.

(2) Non-contact type: the space between the tip portion of the vane and the inner surface of the cylinder is small with respect to all the width of the vane, and thus refrigerant leakage is reduced.

Figure 3:
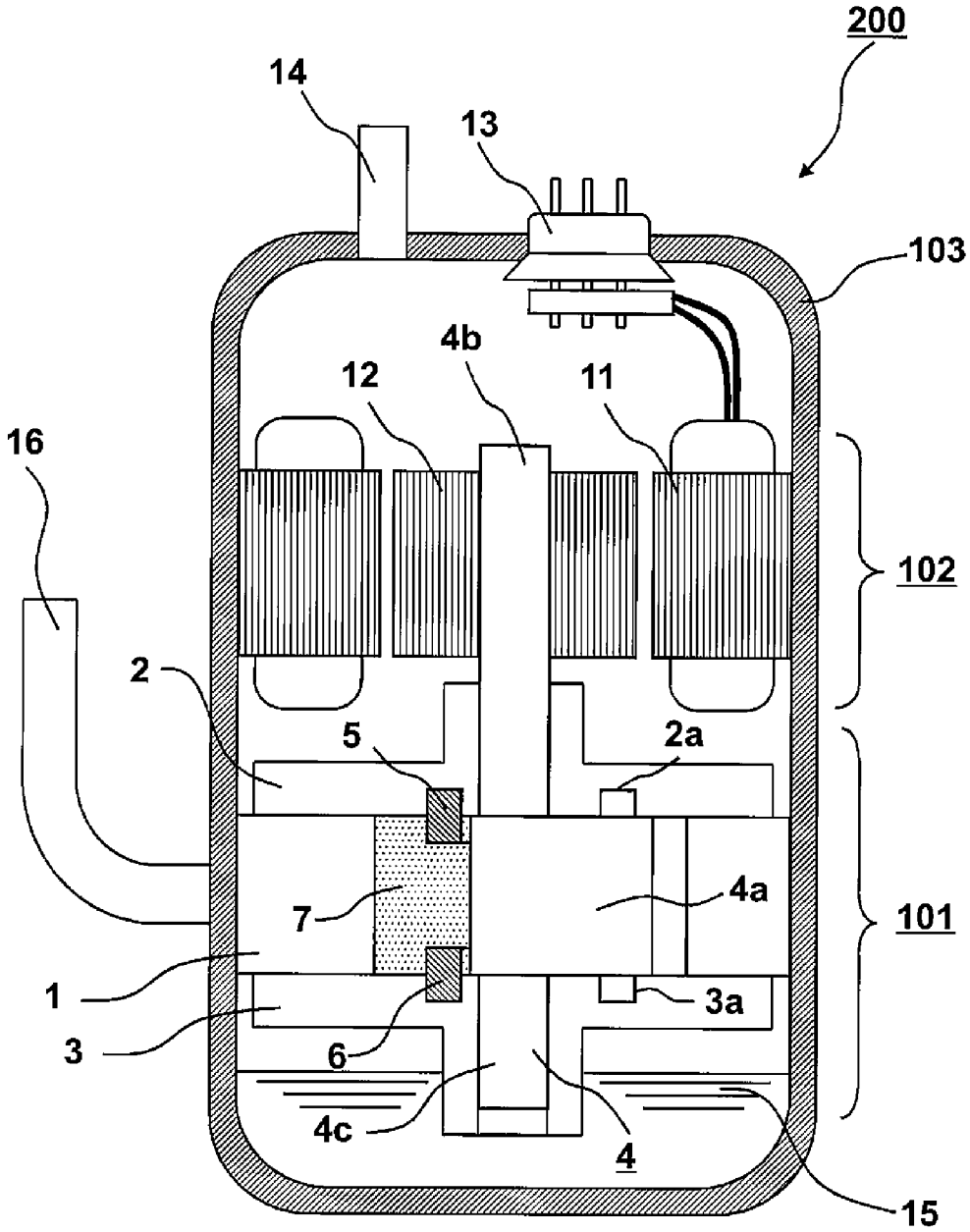
FIG. 3 shows a longitudinal section of a vane compressor 200 according to Embodiment 1.

FIG. 3 shows a longitudinal section of a vane compressor 200 according to Embodiment 1. Referring to FIG. 3, the vane compressor 200 (hermetic type) will be described. However, since the present Embodiment is characterized by a compression mechanism 101, the vane compressor 200 (hermetic type) is described as an example. The present Embodiment is not limited to the hermetic type and thus can also be applied to other structure, such as an engine-driven type or an open container type.

In the vane compressor 200 (hermetic type) shown in FIG. 3, the compression mechanism 101 and an electric motor 102 for driving the compression mechanism 101 are stored in a hermetic container 103. The compression mechanism 101 is located in the lower part of the hermetic container 103 and leads refrigerant oil 15 stored in the bottom of the hermetic container 103 to the compression mechanism 101 by a lubrication mechanism (not shown), and thus each sliding portion in the compression mechanism 101 is lubricated.

The electric motor 102 for driving the compression mechanism 101 is configured by a brushless DC motor, for example. The electric motor 102 includes a stator 11 which is fixed to the inner periphery of the hermetic container 103, and a rotor 12 which is arranged inside the stator 11 and uses a permanent magnet. The stator 11 is supplied with electric power from a glass terminal 13 which is fixed to the hermetic container 103 by welding.

The compression mechanism 101 sucks a low pressure refrigerant into a compression chamber from a suction part 16 so as to compress it. The compressed refrigerant is discharged in the hermetic container 103, and further, passing through the electric motor 102, discharged outside (the high-pressure side of the refrigerating cycle) from a discharge pipe 14 fixed to the upper part of the hermetic container 103. The vane compressor 200 (hermetic type) may be either the high-pressure type with a high pressure in the hermetic container 103 or the low-pressure type with a low pressure in the hermetic container 103.

Figure 4:
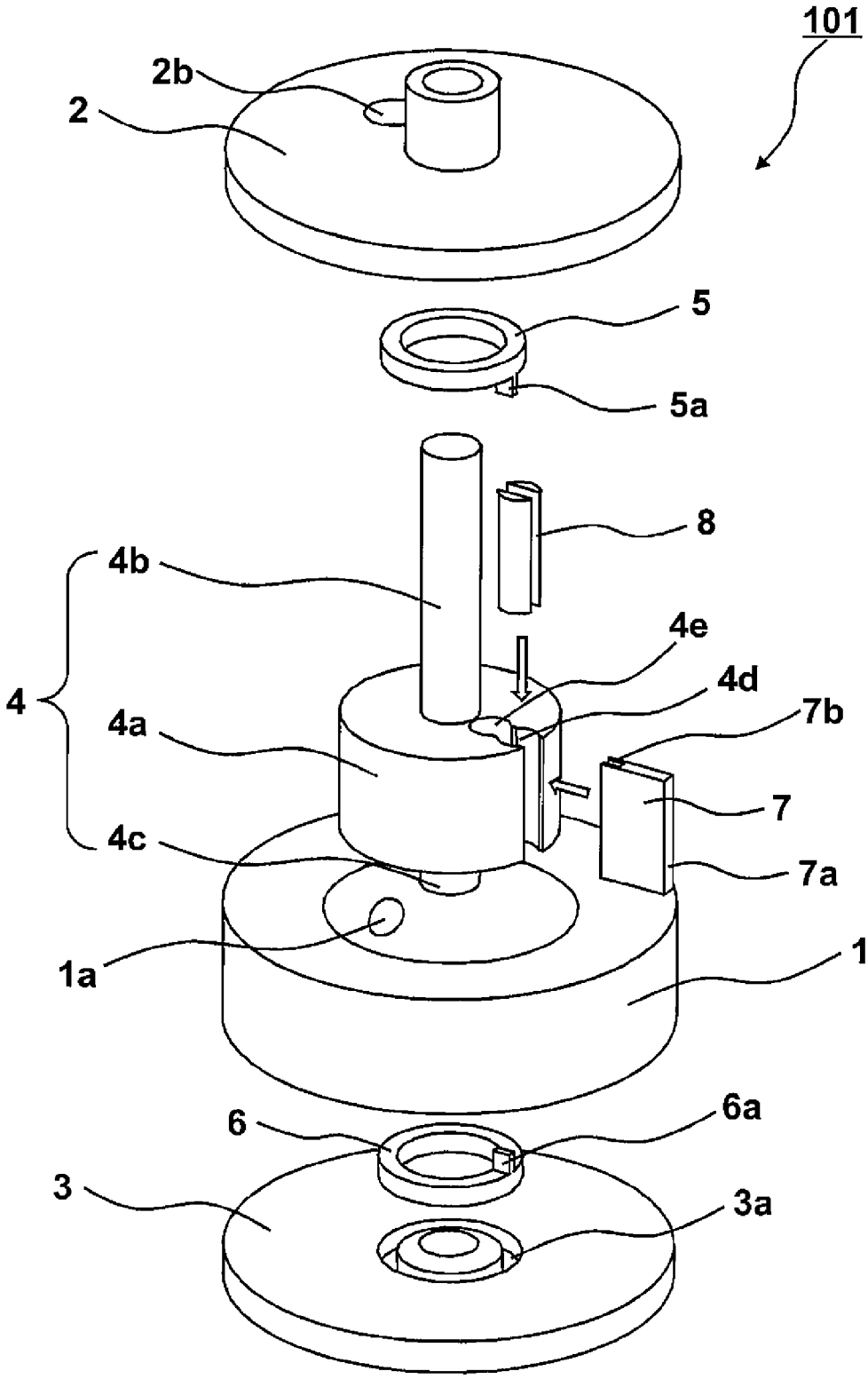
FIG. 4 shows an exploded perspective view of a compression mechanism 101 of the vane compressor 200 according to Embodiment 1.
Figure 5:
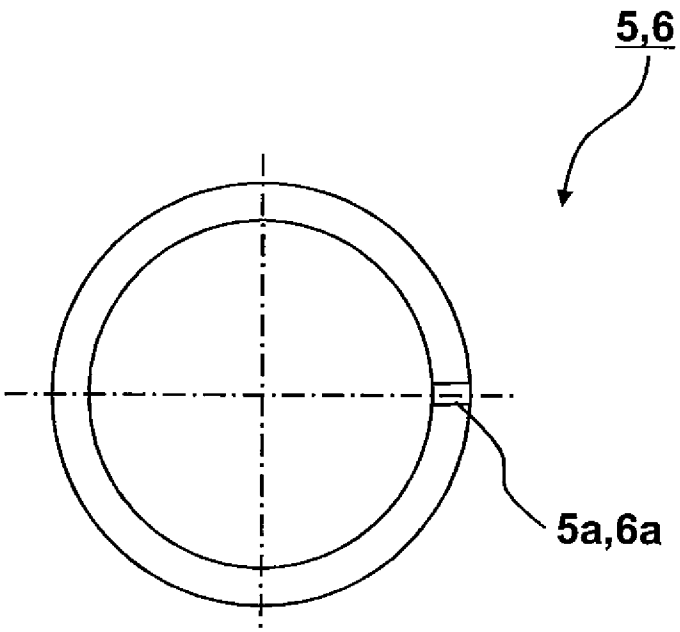
FIG. 5 shows a plan view of vane aligners 5 and 6 according to Embodiment 1.

As this Embodiment is characterized by the compression mechanism 101, details of it will be explained hereafter. Each part of the compression mechanism 101 is denoted by a reference number in FIG. 3, but, since the exploded perspective view of FIG. 4 is easier to understand, the explanation will be performed mainly with reference to FIG. 4 showing the compression mechanism 101 of the vane compressor 200 according to Embodiment 1. Further, FIG. 5 shows a plan view of vane aligners 5 and 6 according to Embodiment 1.

As shown in FIG. 4, the compression mechanism 101 includes elements as described below.

(1) Cylinder 1: The whole shape of the cylinder 1 is approximately cylindrical, and its both end parts located in the axial direction are open. A suction port 1*a* is open on the inner surface of the cylinder 1.

(2) Frame 2: The frame 2 has a longitudinal section approximately in the shape of a letter T, its portion contacting the cylinder 1 being approximately disk-shaped, and closes one opening (the upper one in FIG. 4) of the cylinder 1. A vane aligner supporting part 2*a* (shown only in FIG. 3) being a ring-shaped groove and concentric with the inner surface of the cylinder 1 is formed on the surface at the cylinder 1 side of the frame 2. The vane aligner 5, to be described later, is inserted in the vane aligner supporting part 2*a*. Further, a discharge port 2*b* is formed in approximately the center of the frame 2.

(3) Cylinder head 3: The cylinder head 3 has a longitudinal section approximately in the shape of a letter T (refer to FIG. 3), its portion contacting the cylinder 1 being approximately disk-shaped, and closes the other opening (the lower one in FIG. 4) of the cylinder 1. A vane aligner supporting part 3*a* being a ring-shaped groove and concentric with the inner surface of the cylinder 1 is formed on the surface at the cylinder 1 side of the cylinder head 3. The vane aligner 6 is inserted in the vane aligner supporting part 3*a*.

(4) Rotor shaft 4: The rotor shaft 4 has a configuration where a rotor part 4*a* rotates, inside the cylinder 1, about the central axis which is eccentric to the central axis of the cylinder 1, and the upper and the lower rotary shaft parts 4*b* and 4*c* are integrally combined (refer to FIG. 6 to be described later). A bush supporting part 4*d* and a vane relief part 4*e*, having approximately circular sections and penetrating in the axial direction, are formed in the rotor part 4*a*. The bush supporting part 4*d* and the vane relief part 4*e* are in a connected state.

(5) Vane aligner 5: The vane aligner 5 is a ring-shaped part. A vane supporting part 5*a* being a quadrangular plate-like projection is formed, in a standing manner, on one of the surfaces (in FIG. 4, the downside surface) of the vane aligner 5, where the surfaces are located in the axial direction. The vane supporting part 5*a* is formed in the normal direction of the circular ring of the vane aligner 5 (refer to FIG. 5).

(6) Vane aligner 6: The vane aligner 6 is a ring-shaped part. A vane supporting part 6*a* being a quadrangular plate-like projection is formed, in a standing manner, on one of the surfaces (in FIG. 4, the upside surface) of the vane aligner 6, where the surfaces are located in the axial direction. The vane supporting part 6*a* is formed in the normal direction of the circular ring of the vane aligner 6 (refer to FIG. 5).

(7) Vane 7: The vane 7 is an approximately quadrangular plate-like part. A tip portion 7*a*, located at the inner surface side of the cylinder 1, is formed in the R-shape facing outward. The radius of the R-shape and the radius of the inner surface of the cylinder 1 are configured to be approximately equal to each other. On the back side of the vane 7, namely on the side opposite to the cylinder 1, a back groove 7*b* being slit-like is formed in the entire length of the vane 7 in the axial direction or formed in the length of insertion of the vane supporting part 6*a* of the vane aligner 6.

(8) Bush 8: The bush 8 is a pair of approximately semicircular cylinders, and inserted in the bush supporting part 4*d* of the rotor shaft 4. The plate-like vane 7 is supported inside the bush 8 to be pivotally rotatable with respect to the rotor part 4*a* and movable in the approximately normal direction of the rotor part 4*a*.

Since the vane supporting parts 5*a* and 6*a* of the vane aligners 5 and 6 are inserted in the back groove 7*b* of the vane 7, the direction of the vane 7 is restricted such that the normal to the radius of the tip portion of the vane 7 is always coincident with the normal to the radius of the inner surface of the cylinder.

Operations will now be described. The rotary shaft part 4*b* of the rotor shaft 4 receives rotative power from the driving part of the electric motor 102, etc. (e.g., engine in the engine drive system), and the rotor part 4*a* rotates in the cylinder 1. Along with rotation of the rotor part 4*a*, the bush supporting part 4*d* arranged in the vicinity of the outer surface of the rotor part 4*a* moves on the circumference centering on the central axis of the rotor shaft 4. The bush 8, being a pair of semicircular cylinders, which is supported in the bush supporting part 4*d*, and the vane 7 which is pivotally rotatably supported between the bush 8 rotate with the rotation of the rotor part 4*a*.

In the back groove 7*b* formed in the back side of the vane 7, there are slidably inserted the plate-like vane supporting parts 5*a* and 6*a* (projections) of the ring-shaped vane aligners 5 and 6 which are rotatably inserted in the vane aligner supporting part 2*a* (FIG. 3) and the vane aligner supporting part 3*a* (FIGS. 3 and 4) which are formed on the surfaces at the cylinder side of the frame 2 and the cylinder head 3 and are concentric with the inner surface of the cylinder 1. Thus, the direction of the vane is restricted to be in the normal direction of the cylinder 1.

Moreover, the vane 7 is pressed in the direction of the inner surface of the cylinder 1 by a pressure difference between the tip portion 7*a* and the back groove 7*b* (in the case of a structure of leading high or middle pressure refrigerant to the back space of the vane 7), a spring (not shown), a centrifugal force, etc., and the tip portion 7*a* of the vane 7 slides along the inner surface of the cylinder 1. At this time, since the radius of the vane tip portion 7*a* of the vane 7 and the radius of the inner surface of the cylinder 1 are approximately equal to each other and normals to them are approximately coincident with each other, a sufficient oil film is formed between them to produce a fluid lubrication state.

Figure 6:
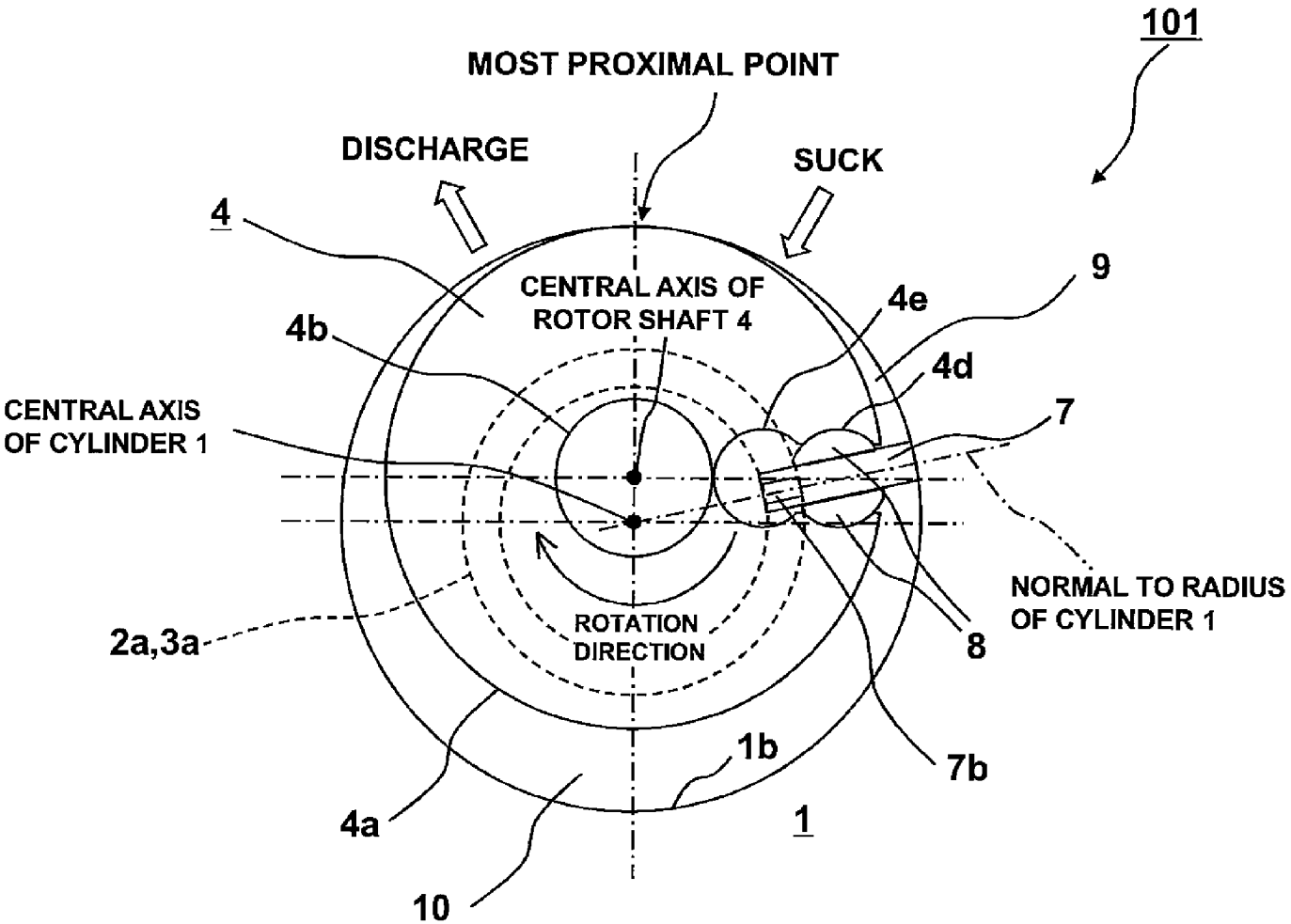
FIG. 6 shows a plan view (angle 90°) of the compression mechanism 101 of the vane compressor 200 according to Embodiment 1.

The compression principle of the vane compressor 100 of the present Embodiment is approximately similar to that of the conventional vane compressor. FIG. 6 shows a plan view (angle 90°) of the compression mechanism 101 of the vane compressor 200 according to Embodiment 1. As shown in FIG. 6, the rotor part 4*a* of the rotor shaft 4 and an inner surface 1*b* of the cylinder 1 are closest at one point (the most proximal point shown in FIG. 6).

Furthermore, since the vane 7 contactingly slides along the inner surface 1*b* of the cylinder 1 at one point, two spaces (a suction chamber 9 and a compression chamber 10) are formed in the cylinder 1. The suction port 1*a* (connected to a low-pressure side of the refrigerating cycle) is open to the suction chamber 9. The compression chamber 10 is connected to the discharge port 2*b* which is closed, except for the time of discharging, by a discharge valve (not shown). The discharge port 2*b* is formed in the frame 2, for example, and may be formed in the cylinder head 3.

Figure 7:
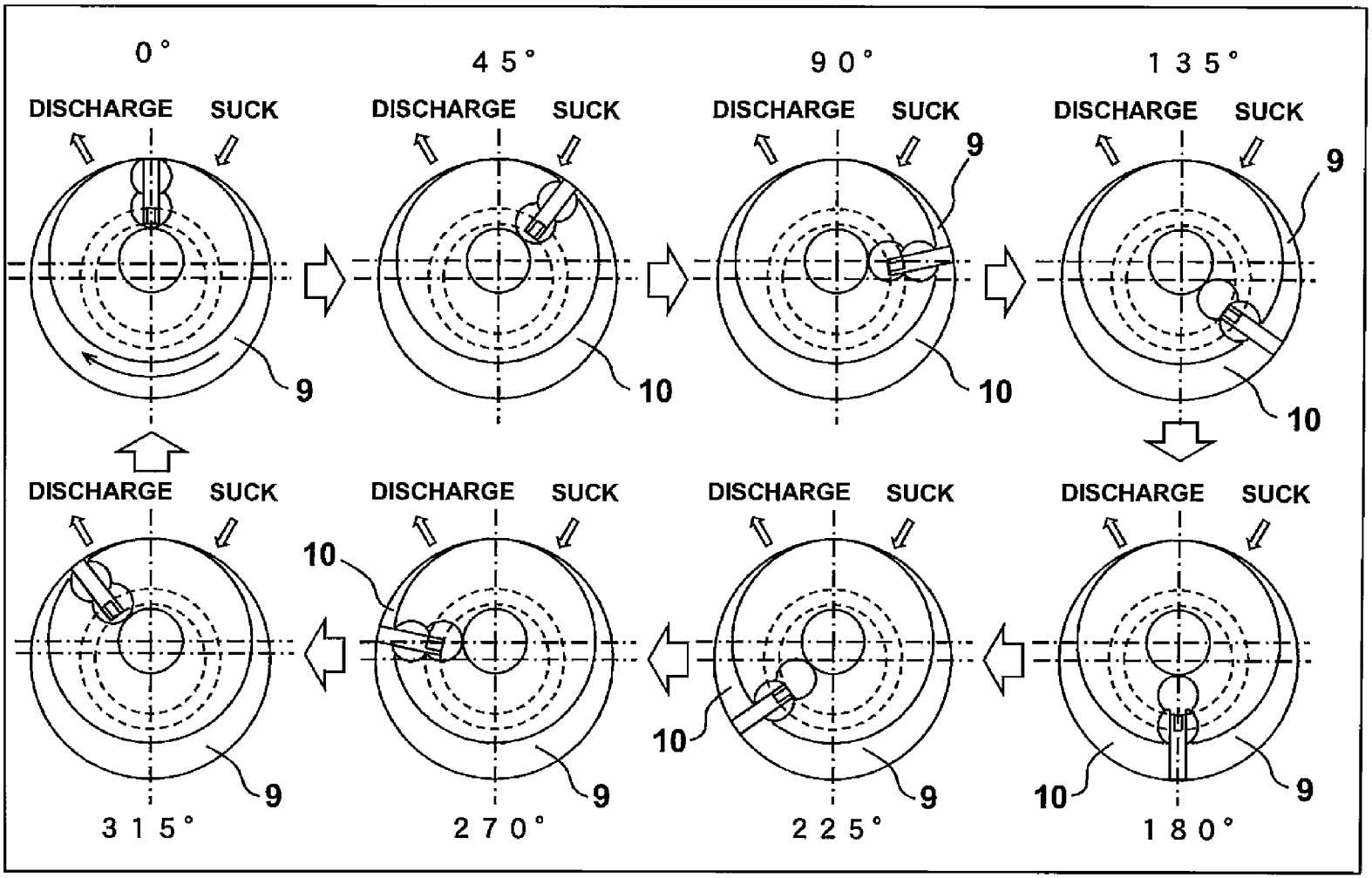
FIG. 7 shows plan views of the compression mechanism 101, illustrating a compression operation of the vane compressor 200, according to Embodiment 1.

FIG. 7 shows plan views of the compression mechanism 101, illustrating a compression operation of the vane compressor 200, according to Embodiment 1. Referring to FIG. 7, there will be described how the volumes of the suction chamber 9 and the compression chamber 10 change along with rotation of the rotor shaft 4. First, the rotation angle in FIG. 7 is defined as follows: when the most proximal point (shown in FIG. 6) between the rotor part 4*a* of the rotor shaft 4 and the inner surface 1*b* of the cylinder 1 is coincident with the point where the vane 7 contactingly slides along the inner surface 1*b* of the cylinder 1, this state is defined as "angle 0". In FIG. 7, there are shown the positions of the vane 7 at the angles of "angle 0°", "angle 45°", "angle 90°", "angle 135°", "angle 180°", "angle 225°", "angle 270°", and "angle 315°", and the states of the suction chamber 9 and the compression chamber 10 at these angles. The single-line arrow shown at the "angle 0°" of FIG. 7 indicates a rotation direction (clockwise rotation in FIG. 7) of the rotor shaft 4. However, the arrow indicating the rotation direction of the rotor shaft 4 is not shown at other angles in FIG. 7.

The suction port 1*a* is located adjacent to the most proximal point (the top dead center) where the rotor part 4*a* of the rotor shaft 4 and the inner surface 1*b* of the cylinder 1 are closest, and is located at the right side (e.g., approximately 30°) of the most proximal point, having a predetermined distance from the most proximal point. However, the suction port 1*a* is just denoted as "suck" in FIGS. 6 and 7.

The discharge port 2*b* is located adjacent to the most proximal point where the rotor part 4*a* of the rotor shaft 4 and the inner surface 1*b* of the cylinder 1 are closest, and is located at the left side (e.g., approximately 30°) of the most proximal point, having a predetermined distance from the most proximal point. However, the discharge port 2*b* is just denoted as "discharge" in FIGS. 6 and 7.

At "angle 0°" in FIG. 7, all the space formed by the inner surface 1*b* of the cylinder 1 and the rotor part 4*a* of the rotor shaft 4 is the suction chamber 9. Then, the suction chamber 9 is connected to the suction port 1*a*.

At "angle 45°" in FIG. 7, the vane 7 passes the suction port 1*a*, and then, the space having been the suction chamber 9 until the vane 7 has passed becomes the compression chamber 10. Although not denoted, the suction chamber 9 of a small volume is also newly formed between the vane 7 and the most proximal point where the rotor part 4*a* of the rotor shaft 4 and the inner surface 1*b* of the cylinder 1 are closest.

At "angle 90°" in FIG. 7, the volume of the compression chamber 10 becomes smaller than that at "angle 45°", and since the refrigerant is compressed, its pressure increases gradually. By contrast, the volume of the suction chamber 9 becomes larger than that at "angle 45°".

At "angle 135°" to "angle 270°" in FIG. 7, the volume of the compression chamber 10 further becomes smaller in order than that at "angle 90°", and the pressure of the refrigerant increases in order. By contrast, the volume of the suction chamber 9 becomes larger in order than that at "angle 90°".

Then, the vane 7 approaches the discharge port 2*b*, and when the pressure of the compression chamber 10 exceeds the high pressure (including a pressure necessary for opening the discharge valve (not shown)) of the refrigerating cycle, the discharge valve is opened and the refrigerant in the compression chamber 10 is discharged in the hermetic container 103.

When the vane 7 passes the discharge port 2*b*, the high pressure refrigerant remains a little (becoming a loss) in the compression chamber 10. Then, when the compression chamber 10 disappears at "angle 0°", the high pressure refrigerant changes in the suction chamber 9 to a low pressure refrigerant.

As described above, by the rotation of the rotor shaft 4, the volume of the suction chamber 9 being one of the spaces gradually becomes larger, and the volume of the compression chamber 10 being the other one of the spaces gradually becomes smaller, and thus the fluid (refrigerant) inside is compressed. The gas compressed to a predetermined pressure is discharged from a discharge port (e.g., the discharge port 2*b*) which is formed in the cylinder 1 or in the portion, open to the compression chamber 10, of the frame 2 or the cylinder head 3.

According to the present Embodiment, by virtue of the configuration in which a fluid lubrication state is produced by making the radius of the tip portion 7*a* of the vane 7 and the radius of the inner surface of the cylinder 1 approximately equal to each other and performing sliding such that the normals to the radii are coincident with each other, there are effects of greatly reducing the sliding loss of the vane compressor 200 owing to decreasing the sliding resistance of the tip portion 7*a* of the vane 7, and minimizing abrasion of the tip portion 7*a* of the vane 7 and the inner surface of the cylinder 1.

Moreover, since the vane 7 is supported, through the bush 8, being a pair of semicircular cylinders, in the bush supporting part 4*d* of the rotor part 4*a* and sliding is performed in a fitting manner between the outer surface of the bush 8 and the bush supporting part 4*d*, and between the bush 8 and the side surface of the vane 7, a fluid lubrication state is herein also produced, thereby having an effect of reducing mechanical loss caused by sliding/contacting.

Furthermore, although the vane aligner supporting parts 2*a* and 3*a* formed in the frame 2 and the cylinder head 3 are ring-shaped grooves in the present Embodiment, since the portion contactingly sliding along the vane aligner 5 or 6 is the inner surface or the outer surface of the ring-shaped groove, it is not always necessary for the shape of the vane aligner supporting parts 2*a* and 3*a* to be a ring-shaped groove. Thus, the shape may be a concave portion with a circular section. In that case, the inner diameter of the concave portion is equal to that of the ring-shaped groove.

Moreover, although not shown in the figure, if the vane pressing force is reduced by controlling, the vane back pressure, which is a conventional technique, in the configuration of the present Embodiment, it is possible to further reduce the sliding resistance of the vane tip portion.

In the present Embodiment, there has been described a method of restricting the direction of the vane 7 by inserting the vane supporting parts 5*a* and 6*a* of the vane aligners 5 and 6 in the back groove 7*b* of the vane. The vane supporting parts 5*a* and 6*a* and the back groove 7*b* of the vane 7 respectively include thin-walled parts.

Since the vane supporting parts 5*a* and 6*a* are quadrangular plate-like projections as shown in FIG. 4, their strength is low.

Figure 8:
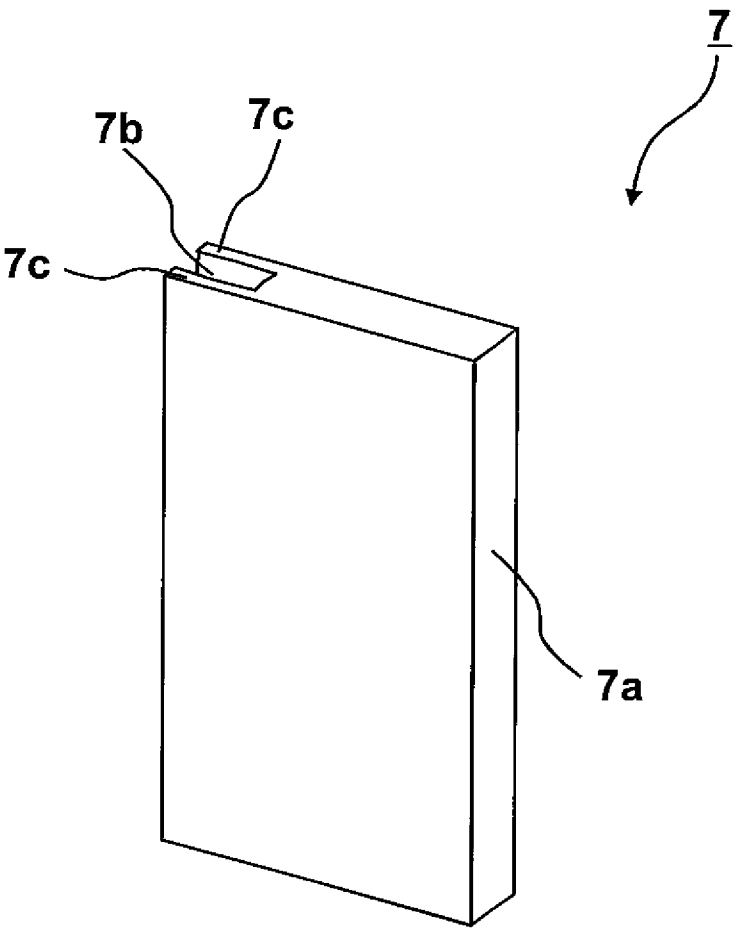
FIG. 8 shows a perspective view of a vane 7 according to Embodiment 1.

FIG. 8 shows a perspective view of the vane 7 according to Embodiment 1. The vane 7 includes thin-walled parts 7*c* at both the sides of the back groove 7*b*.

Therefore, for applying the method of the present Embodiment, it is preferable to use refrigerant with a low operating pressure, namely a small force acting on the vane 7. For example, refrigerant with a normal boiling point greater than or equal to −45° C. is suitable, and refrigerant, such as R600a (isobutane), R600 (butane), R290 (propane), R134a, R152a, R161, R407C, R1234yf, R1234ze, etc., can be used without any problem in view of the strength of the vane supporting parts 5*a* and 6*a* and the back groove 7*b* of the vane 7.

Embodiment 2

Figure 9:
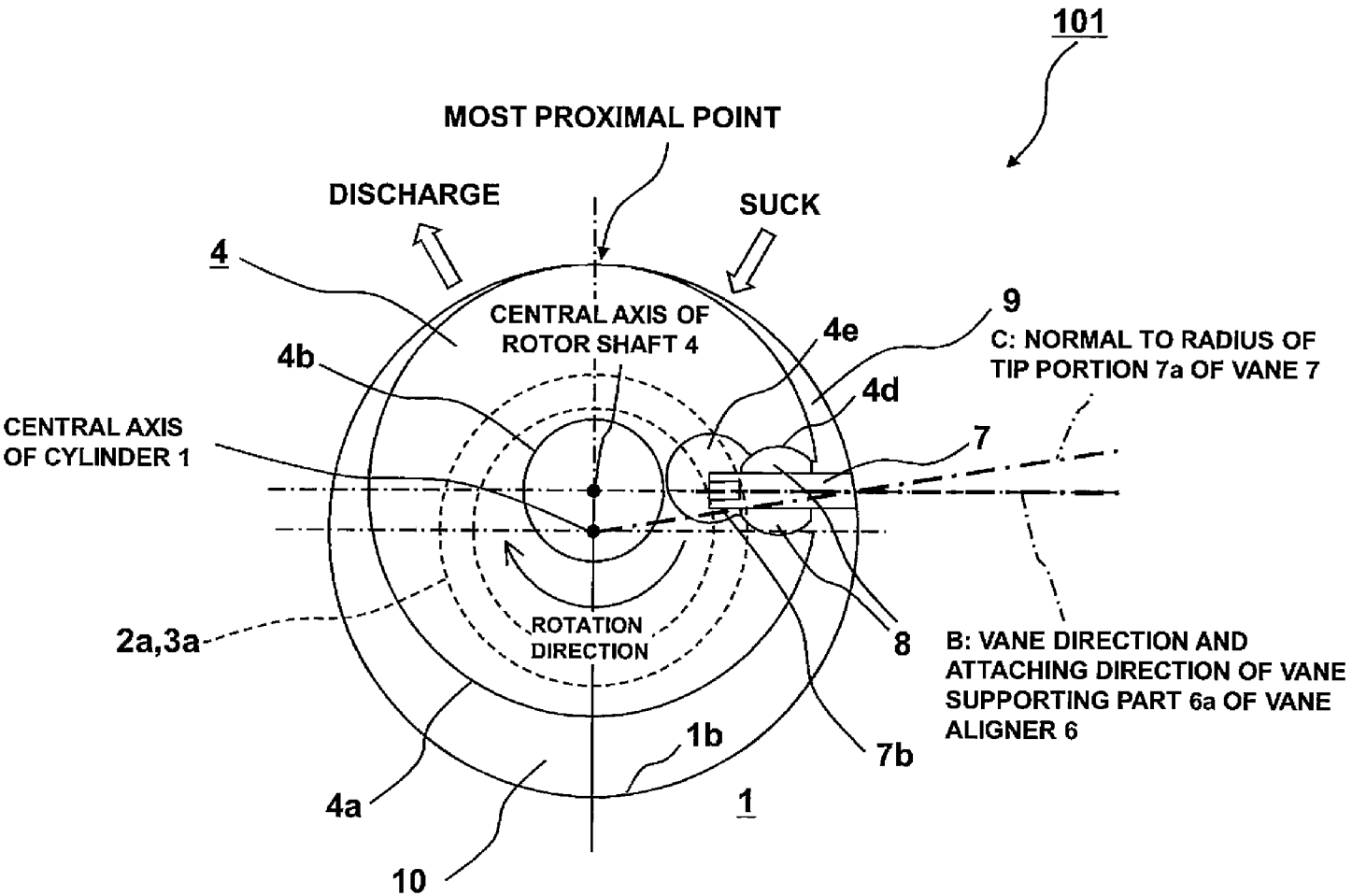
FIG. 9 shows a plan view (angle 90°) of a compression mechanism 101 of a vane compressor 200 according to Embodiment 2.

FIG. 9 shows a plan view (angle 90°) of the compression mechanism 101 of the vane compressor 200 according to Embodiment 2. FIG. 9 shows the case of the direction of the vane 7 being a scooping type where the angle of the direction of the vane is inclined toward the direction of rotation with respect to the normal to the cylinder inner surface. In FIG. 9, B denotes the direction of the vane and the attaching direction of the vane supporting part 6*a* of the vane aligner 6, C denotes the normal to the radius of the tip portion 7*a* of the vane 7, and the single line arrow denotes the rotation direction. The vane supporting part 6*a* of the vane aligner 6 is attached in the direction of B on the surface of the ring-shaped part of the vane aligner 6. The normal C to the radius of the tip portion 7*a* of the vane 7 has a gradient to the vane direction B and is toward the center of the cylinder 1 in the state where the projection (the vane supporting part) 6*a* of the vane aligner 6 is inserted in the back groove 7*b* of the vane 7, that is, the normal C to the radius of the tip portion 7*a* of the vane 7 is approximately coincident with the normal to the inner surface of the cylinder 1. Further, the same configuration described above is also applied for the vane 7 and the vane aligner 5.

Then, also in the configuration of Embodiment 2 described above, since the compression operation can be performed in the state where the normal to the radius of the tip portion 7*a* of the vane 7 and the normal to the radius of the inner surface of the cylinder 1 are always coincident with each other during the rotation, the same effect as that of Embodiment 1 of the present invention is obtained. Moreover, in Embodiment 2, as seen in FIG. 9, since the length of the R portion of the tip portion 7*a* of the vane 7 can be made longer than that of Embodiment 1, it is possible to reduce the contact surface pressure between the tip of the vane 7 and the inner surface of the cylinder 1. Thereby, the sliding resistance of the tip portion 7*a* of the vane 7 can be further reduced. Although FIG. 9 shows the direction of the vane 7 of a scooping type, the same effect can also be obtained by a trailing type where the angle of the direction of the vane 7 is inclined toward the opposite direction of rotation with respect to the normal to the inner surface of the cylinder 1.

Embodiment 3

Figure 10:
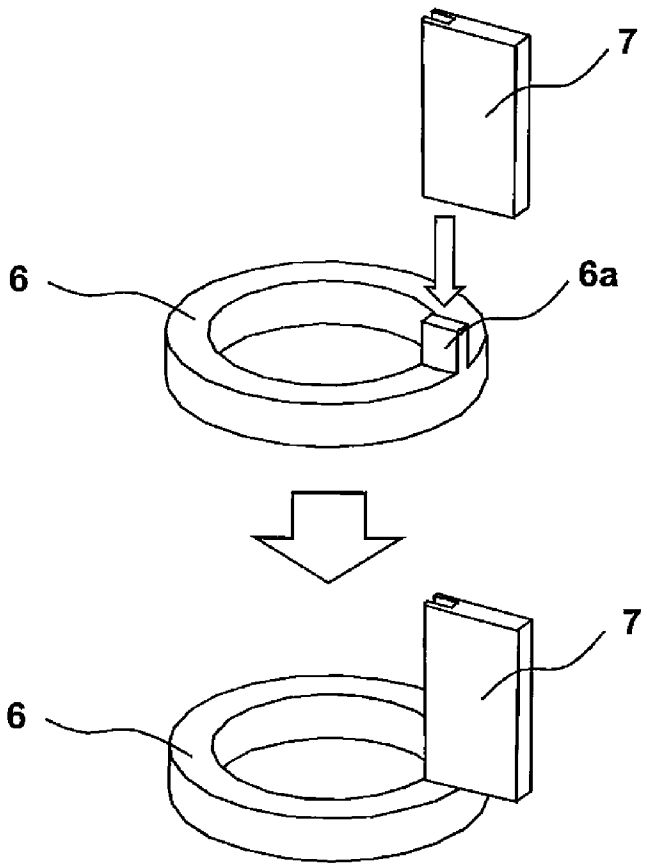
FIG. 10 shows a configuration where a vane 7 and a vane aligner 6 are integrally combined with each other according to Embodiment 3.

FIG. 10 shows a configuration where the vane 7 and the vane aligner 6 are integrally combined with each other according to Embodiment 3. In Embodiment 1 described above, the relative position between the back groove 7*b* of the vane 7 and the vane supporting part 5*a* of the vane aligner 5 or the vane supporting part 6*a* of the vane aligner 6 does not change during the operation of the vane compressor 200. Therefore, it is possible to combine the both (the vane 7, and the vane aligners 5 and 6) integrally. Although FIG. 10 shows the case where only the vane aligner 6 and the vane 7 are integrally combined with each other, the vane aligner 5 may or may not be similarly integrated. Anyhow, the vane 7 and at least one of the vane aligners 5 and 6 are integrally combined.

Operations will now be described. In Embodiment 3, the operation is performed approximately similarly to Embodiment 1, but it differs from Embodiment 1 in that since the vane 7 is integrally combined with at least one of the vane aligners 5 and 6, its movement in the normal direction of the rotor part is fixed not to move, thereby, the tip portion 7*a* of the vane 7 does not contactingly slide along the inner surface 1*b* of the cylinder 1, and thus the rotation is performed while maintaining a non-contact state and a minute space therebetween.

That is, according to the present Embodiment, since the tip portion 7*a* of the vane 7 and the inner surface of the cylinder 1 are in non-contact with each other, the sliding loss of the tip portion 7*a* of the vane 7 is not produced. Because of no sliding loss at the tip portion 7*a*, sliding portions between the vane aligners 5 and 6 and the vane aligner supporting parts 2*a* and 3*a* are to receive a large force, but however, since the sliding portions are also in the state of the fluid lubrication and the sliding distance of the guide unit (the bush 8 being a pair of parts) is shorter than that of the tip portion 7*a* of the vane 7, there is an effect of further reducing the sliding loss compared with Embodiment 1.

Furthermore, although also not shown in the drawings in Embodiment 3, similarly to Embodiment 2, it is also acceptable to configure such that the normal to the radius of the tip portion 7*a* of the vane 7 is approximately coincident with the normal to the radius of the inner surface of the cylinder 1, and the direction of the vane 7 has a fixed inclination with respect to the normal direction of the radius of the inner surface of the cylinder 1. Thereby, the length of the R portion of the tip portion 7*a* of the vane 7 can be elongated, and thus, by increasing the seal length, it is possible to further reduce the leakage loss at the tip portion 7*a* of the vane 7.

In the vane compressor according to the Embodiment described above, the radius of the vane tip portion and the radius of the cylinder inner surface are formed to be approximately equal to each other and the compression operation is performed in the state where the normals to both the radii are always approximately coincident with each other, and therefore the tip portion of the vane and the cylinder can be in a fluid lubrication state. Thus, mechanical loss caused by sliding/contacting can be reduced and a life-span affected by abrasion between the vane tip portion and the cylinder inner surface can be improved.

In the vane compressor according to the Embodiment described above, the vane is supported to be always in the normal direction of the inner surface of the cylinder or to always have a fixed inclination with respect to the normal direction of the inner surface of the cylinder, and further supported, in the rotor part, to be pivotally rotatable with respect to the rotor part and movable in a generally centrifugal direction of the rotor part. As a method for supporting the vane so that the vane may always be in the normal direction of the cylinder inner surface or have a fixed inclination with respect to the normal direction of the cylinder inner surface, there is formed a concave portion or a ring-shaped groove, being concentric with the inner surface of the cylinder, on the surface at the cylinder side of the cylinder head and/or the frame. Then, in this concave portion or ring-shaped groove, the vane aligner having a plate-like projection on its ring-shaped surface is inserted, and further, the plate-like projection is inserted in the groove formed in the vane. Thereby, the vane direction with respect to the normal to the cylinder is restricted to be predeterminedly fixed. Therefore, the mechanism of the vane rotating about the center of the cylinder in order to perform a compression operation such that the normal to the radius of the vane tip portion and the normal to the radius of the cylinder inner surface are always approximately coincident with each other is realized by the configuration of integrally combined rotor and rotary shaft, without using end plates of the rotor which cause degradation of the precision of the rotor outer surface and the rotation center.

In the vane compressor according to the embodiment described above, at least one of the vane aligners, at one end or both ends of the vane, is integrally combined with the vane, and therefore it is possible, while keeping the vane tip portion and the cylinder inner surface to be in non-contact with each other, to minimize gas leakage from the space between the vane tip portion and the cylinder inner surface.

In the vane compressor according to the embodiment described above, as a method for supporting the vane, in the rotor part, to be pivotally rotatable with respect to the rotor part and movable in a generally centrifugal direction of the rotor part, the bush supporting part, being cylindrical and parallel to the central axis of the rotor part, is formed in the vicinity of the outer surface of the rotor part and the vane is supported in the bush supporting part through a bush being a pair of approximately semicircular cylindrical members. Therefore, the mechanism that, in the rotor part, the vane is pivotally rotatable with respect to the rotor part and movable in the approximately normal direction can be realized by the method in which sliding is performed in a fluid lubrication state.

Reference Signs List

1: cylinder, 1*a*: suction port, 1*b*: inner surface, 2: frame, 2*a*: vane aligner supporting part, 2*b*: discharge port, 3: cylinder head, 3*a*: vane aligner supporting part, 4: rotor shaft, 4*a*: rotor part, 4*b*: rotary shaft part, 4*c*: rotary shaft part, 4*d*: bush supporting part, 4*e*: vane relief part, 5: vane aligner, 5*a*: vane supporting part, 6: vane aligner, 6*a*: vane supporting part, 7: vane, 7*a*: tip portion, 7*b*: back groove, 7*c*: thin-walled part, 8: bush, 9: suction chamber, 10: compression chamber, 11: stator, 12: rotor, 13: glass terminal, 14: discharge pipe, 15: refrigerant oil, 16: suction part, 101: compression mechanism, 102: electric motor, 103: hermetic container, 200: vane compressor

What is claimed is:

1. A vane compressor comprising:

a cylinder which is approximately cylindrical;

a frame which closes one axial end of the cylinder;

a cylinder head which closes an opposing axial end of the cylinder;

a rotor shaft which includes a rotary shaft part supported by the frame and the cylinder head and being eccentric to a center of an inner peripheral surface of the cylinder, and a rotor part which rotates about the rotary shaft part in the cylinder; and a vane which is installed in the rotor part, an outer periphery of a tip portion of the vane being curved in an arc shape;

wherein the tip portion of the vane moves in the cylinder along with rotation of the rotor part in a state where a normal to the outer periphery of the tip portion of the vane and a normal to an inner periphery of the cylinder are approximately coincident with each other; and in a compression operation a normal to the outer periphery of the tip portion of the vane and a normal to an inner surface of the cylinder always intersect the central axis of the cylinder so that the normal to the outer periphery of the tip portion of the vane and the normal to an inner surface of the cylinder are always approximately coincident with each other.

2. The vane compressor according to claim 1, wherein a radius of the outer periphery of the tip portion of the vane and a radius of the inner periphery of the cylinder are approximately equal to each other.

3. The vane compressor according to claim 1, wherein the vane is supported to be rotatable with respect to the rotor part and movable in a substantially centrifugal direction of the rotor part.

4. The vane compressor according to claim 1, wherein the tip portion of the vane is a longitudinal tip portion of the vane, and the vane is supported so that a longitudinal direction of the vane has a fixed inclination with respect to a direction of the normal to the inner periphery of the cylinder.

5. The vane compressor according to claim 1, further comprising a vane aligner attached to an end surface of at least one of the frame and the cylinder head on a side of the cylinder to rotate about an axis concentric with the inner periphery of the cylinder, the vane aligner supporting the vane.

6. The vane compressor according to claim 5, wherein a concave portion whose inner periphery is concentric with the inner periphery of the cylinder is formed in the end surface of at least one of the frame and the cylinder head on the side of the cylinder, and the vane aligner is provided to slide along the inner periphery of the concave portion.

7. The vane compressor according to claim 6, wherein the concave portion is a ring-shaped groove.

8. The vane compressor according to claim 5, wherein the vane aligner is unitarily formed with the vane.

9. The vane compressor according to claim 5, wherein the vane aligner supports the vane such that the tip portion of the vane slides along the inner periphery of the cylinder along with rotation of the rotor part.

10. The vane compressor according to claim 5, wherein the vane aligner supports the vane such that the tip portion of the vane moves along the inner periphery of the cylinder along with rotation of the rotor part while maintaining a space between the tip portion of the vane and the inner periphery of the cylinder.

11. The vane compressor according to claim 5, wherein a bush supporting part penetrating axially is formed in the rotor part, and the vane compressor further comprises a pair of approximately semi-columnar bushes inserted in the bush supporting part to support the vane by sandwiching the vane, wherein the vane aligner supports the vane such that the vane is rotatable about a central axis of the bush supporting part.

12. The vane compressor according to claim 5, wherein the vane aligner includes a plate-like projection inserted in a groove formed in the vane.

13. The vane compressor according to claim 1, configured to compress a refrigerant having a normal boiling point of minus 45 degrees Celsius or higher.

14. A vane compressor comprising:

a cylinder which is approximately cylindrical;

a frame which closes one axial end of the cylinder;

a cylinder head which closes an opposing axial end of the cylinder;

a rotor shaft which includes a rotary shaft part supported by the frame and the cylinder head and being eccentric to a center of an inner peripheral surface of the cylinder, and a rotor part which rotates about the rotary shaft part in the cylinder;

a vane which is installed in the rotor part, an outer periphery of a tip portion of the vane being curved in an arc shape; and a vane aligner attached to an end surface of at least one of the frame and the cylinder head on a side of the cylinder to rotate about an axis concentric with the inner periphery of the cylinder, the vane aligner supporting the vane such that the tip portion of the vane slides along the inner periphery of the cylinder along with rotation of the rotor part, wherein the tip portion of the vane moves in the cylinder along with rotation of the rotor part in a state where a normal to the outer periphery of the tip portion of the vane and a normal to an inner periphery of the cylinder are approximately coincident with each other.

15. A vane compressor comprising:

a cylinder which is approximately cylindrical;

a frame which closes one axial end of the cylinder;

a cylinder head which closes an opposing axial end of the cylinder;

a rotor shaft which includes a rotary shaft part supported by the frame and the cylinder head and being eccentric to a center of an inner peripheral surface of the cylinder, and a rotor part which rotates about the rotary shaft part in the cylinder;

a vane which is installed in the rotor part, an outer periphery of a tip portion of the vane being curved in an arc shape; and a vane aligner attached to an end surface of at least one of the frame and the cylinder head on a side of the cylinder to rotate about an axis concentric with the inner periphery of the cylinder, the vane aligner supporting the vane such that the tip portion of the vane moves along the inner periphery of the cylinder along with rotation of the rotor part while maintaining a space between the tip portion of the vane and the inner periphery of the cylinder, wherein the tip portion of the vane moves in the cylinder along with rotation of the rotor part in a state where a normal to the outer periphery of the tip portion of the vane and a normal to an inner periphery of the cylinder are approximately coincident with each other.

16. A vane compressor comprising:

a cylinder which is approximately cylindrical;

a frame which closes one axial end of the cylinder;

a cylinder head which closes an opposing axial end of the cylinder;

a rotor shaft which includes a rotary shaft part supported by the frame and the cylinder head and being eccentric to a center of an inner peripheral surface of the cylinder, and a rotor part which rotates about the rotary shaft part in the cylinder;

a vane which is installed in the rotor part, an outer periphery of a tip portion of the vane being curved in an arc shape;

a bush supporting part penetrating axially that is formed in the rotor part;

a pair of approximately semi-columnar bushes inserted in the bush supporting part to support the vane by sandwiching the vane; and a vane aligner attached to an end surface of at least one of the frame and the cylinder head on a side of the cylinder to rotate about an axis concentric with the inner periphery of the cylinder, the vane aligner supporting the vane such that the vane is rotatable about a central axis of the bush supporting part, wherein the tip portion of the vane moves in the cylinder along with rotation of the rotor part in a state where a normal to the outer periphery of the tip portion of the vane and a normal to an inner periphery of the cylinder are approximately coincident with each other.

* * * * *